US006113468A

United States Patent [19]

Natalicio

[11] Patent Number: 6,113,468

[45] Date of Patent: Sep. 5, 2000

[54] WAFER PLANARIZATION CARRIER HAVING FLOATING PAD LOAD RING

[75] Inventor: John Natalicio, Los Angeles, Calif.

[73] Assignee: Speedfam-Ipec Corporation, Chandler, Ariz.

[21] Appl. No.: 09/286,702

[22] Filed: Apr. 6, 1999

[51] Int. Cl.[7] ..... B24B 5/00

[52] U.S. Cl. ..... 451/41; 451/55; 451/59

[58] Field of Search ..... 451/41, 285, 287, 451/288, 54, 55, 59, 63

[56] References Cited

U.S. PATENT DOCUMENTS

| | | | |
|---|---|---|---|
| 5,205,082 | 4/1993 | Shendon et al. . | |
| 5,584,751 | 12/1996 | Kobayashi et al. . | |
| 5,681,215 | 10/1997 | Sherwood et al. . | |
| 5,716,258 | 2/1998 | Metcalf . | |
| 5,738,574 | 4/1998 | Tolles et al. | 451/287 |
| 5,762,539 | 6/1998 | Nakashiba et al. | 451/41 |
| 5,795,215 | 8/1998 | Guthrie et al. | 451/288 |
| 5,803,799 | 9/1998 | Volodarsky et al. | 451/287 |
| 5,916,015 | 6/1999 | Natalicio . | |

FOREIGN PATENT DOCUMENTS 09017760 1/1997 Japan .

*Primary Examiner*—Eileen P. Morgan
*Attorney, Agent, or Firm*—Snell & Wilmer

[57] ABSTRACT

A wafer carrier for polishing or planarizing semiconductor workpieces or wafers includes a pressure plate configured to hold a wafer to be polished or to be planarized against a polishing pad, and is further configured to rotate the wafer during the polishing or planarizing process. A retaining ring for holding the wafer is mounted about the periphery of the pressure plate. The retaining ring slides vertically and independently relative to the pressure plate. A polishing pad load ring is also slideably mounted about the periphery of the retaining ring. The pad load ring is biased against the polishing pad, and slides vertically and independently of the pressure plate and the wafer retaining ring. In operation, the wafer carrier is moved across the polishing pad, which is sufficiently compliant to cause wave deformation of the surface of the pad. The pad load ring provides a buffer area which displaces wave deformation of the polishing pad away from the edge of the wafer, and thus minimizes the beveling of the wafer lower peripheral edge.

14 Claims, 3 Drawing Sheets

WAFER PLANARIZATION CARRIER HAVING FLOATING PAD LOAD RING

BACKGROUND OF THE INVENTION

1. Technical Field

The present invention relates, generally, to machines for polishing or planarizing workpieces such as semiconductor wafers. More particularly, the present invention relates to a device which supports and engages a workpiece against a polishing pad surface.

2. Background Art and Technical Problems

Many electronic and computer-related products such as semiconductors, CD-ROMs, and computer hard disks, require highly polished surfaces in order to achieve optimum operational characteristics. Silicon workpieces or wafers are typically flat and circular in shape. For example, high-quality and extremely precise wafer surfaces are often needed during the production of semiconductor-based integrated circuits. During the fabrication process, the wafers generally undergo multiple masking, etching, and dielectric and conductor deposition processes. Because of the high-precision required in the production of these integrated circuits, an extremely flat surface is generally needed on at least one side of the semiconductor wafer to ensure proper accuracy and performance of the microelectronic structures created on the wafer surface. As the size of integrated circuits decreases and the density of microstructures on integrated circuits increases, so too must the accuracy and precision of the wafer surface polishing also increase.

Chemical Mechanical Planarization ("CMP") machines have been developed to polish or planarize silicon wafer surfaces to the flat condition desired for manufacture of integrated circuit components and the like. For examples of conventional CMP processes and machines, see U.S. Pat. No. 4,805,348, issued in February 1989 to Arai et al.; U.S. Pat. No. 4,811,522, issued in March 1989 to Gill; U.S. Pat. No. 5,099,614, issued in March 1992 to Arai et al.; U.S. Pat. No. 5,329,732, issued in July 1994 to Karlsrud et al.; U.S. Pat. No. 5,476,890, issued in December 1995 to Masayoshi et al.; U.S. Pat. Nos. 5,498,196 and 5,498,199, both issued in March 1996 to Karlsrud et al.; U.S. Pat. No. 5,558,568, issued in September 1996 to Talieh et al; and U.S. Pat. No. 5,584,751, issued in December 1996 to Kobayashi et al.

Typically, a CMP machine includes a wafer carrier configured to hold and to rotate a wafer during the polishing or the planarizing of the wafer. The wafer carrier is rotated to cause relative lateral motion between the polishing pad and the wafer to produce a more uniform thickness. In general, the polishing surface includes a horizontal polishing pad that has an exposed abrasive surface of cerium oxide, aluminum oxide, fumed/precipitated silica, or other particulate abrasives. Commercially available polishing pads may utilize various materials, as is known in the art. Typically, polishing pads may be formed from a blown polyurethane, such as the IC and GS series of polishing pads available from Rodel Products Corporation in Scottsdale, Ariz. The hardness and density of the polishing pad depends on the material that is to be polished and the degree of precision required in the polishing process.

During a polishing operation, a pressure plate, which forms the bottom of the wafer carrier, applies pressure to the wafer such that the wafer engages the polishing pad with a desired amount of pressure. The pressure plate and the polishing pad are also rotated, typically with differential velocities, to cause relative lateral motion between the polishing pad and the wafer to produce a more uniform thickness. The pressure applied through the wafer to the polishing pad causes the polishing pad to deform underneath the wafer surface, causing a 'footprint'. As the wafer carrier moves across the polishing pad, the wafer footprint also moves with respect to the polishing pad. Therefore, elastic deformation and 'spring-back' (swelling) of the polishing pad along the outer edge of the wafer continuously occurs during the polishing process. This effect is hereinafter referred to as 'pad wave deformation'. The resulting non-uniformity of the polishing pad at the wafer edge causes an undesirable beveling of the wafer edge. Previously known methods for improving wafer flatness have addressed the wafer/polishing pad interface as a static footprint only, and thus these methods have not solved the problems resulting from the actual dynamic nature of the wafer footprint.

Prior attempts at reducing the effects of pad wave deformation include controlling the biasing pressure applied to the area outside the periphery of the wafer by the use of two separate fluid (air) pressure regulating mechanisms. Kobayashi et al. '751 teaches a first pressure regulating mechanism for controlling the biasing pressure applied to a wafer retaining ring and a second pressure regulating mechanism for controlling the pressure applied to the pressure plate. However, the use of two separate mechanisms to regulate air or other fluid pressure requires that the wafer polishing machine and each wafer carrier be provided with additional fluid lines, valves, and associated control equipment.

Therefore, an improved wafer carrier assembly and, in particular, a method for reducing the beveling effects of polishing pad wave deformation, is needed to address the above described limitations of the prior art.

SUMMARY OF THE INVENTION

Solution

The present invention provides methods and apparatus for supporting and engaging workpieces against a polishing surface which overcome many of the shortcomings of the prior art. In accordance with an exemplary embodiment of the present invention, a wafer carrier for polishing or planarizing semiconductor workpieces or wafers includes a pressure plate attached to a wafer carrier housing. The pressure plate is configured to hold a wafer to be polished or to be planarized against a polishing pad, and is further configured to rotate the wafer during the polishing or planarizing process. A retaining ring for holding the wafer is mounted about the periphery of the pressure plate. The retaining ring slides vertically and independently relative to the pressure plate. A polishing pad load ring is also slideably mounted about the periphery of the retaining ring. The pad load ring is biased against the polishing pad, and slides vertically and independently of the pressure plate and the wafer retaining ring. The pad load ring provides a buffer area which displaces the polishing pad wave deformation away from the edge of the wafer, and thus minimizes the beveling of the wafer lower peripheral edge.

In accordance with another aspect of the present invention, biasing of the pressure plate, the pad load ring, and the wafer retaining ring is controlled by air pressure from a common (single) source, thus eliminating the added complexity of the additional fluid lines, valves, and associated control equipment employed by the prior art.

In operation, pressurized air is supplied to a first chamber in the wafer carrier through which the air pressure is applied to the pressure plate. A second chamber receives the pressurized air from the first chamber via an aperture in the wafer carrier body. Bias pressure is thus applied to both the wafer retaining ring and the pad load ring by the air from the same source that biases the pressure plate. In order to transmit and control the pressure applied to the retaining ring and pad pressure ring, a pair of concentric pistons are disposed in the second chamber. The inner piston is connected to the wafer retaining ring, and the outer piston is connected to the pad load ring. Although the air pressure in the second chamber is essentially equal to the pressure in the first chamber, the bias pressure applied to the surface of the polishing pad by each ring is separately established. The bias pressure applied to the retaining ring and pad pressure ring is determined by the ratio of the surface area of the top of each of these pistons relative to the surface area of the bottom of the ring connected to that particular piston. Therefore, the relative bias pressures asserted by the wafer retaining ring and the pad load ring are established by selecting appropriate dimensions (widths) for each of the piston top surfaces relative to the width of the attached ring.

The present invention thus provides a means of reducing the beveling of the bottom of the peripheral edge of a wafer due to polishing pad wave deformation, while eliminating the complexity of two separate air pressure regulating mechanisms in the wafer polishing apparatus.

BRIEF DESCRIPTION OF THE DRAWING

The invention may be better understood from a reading of the following description thereof taken in conjunction with the drawing in which.

DETAILED DESCRIPTION

The subject invention relates generally to the planarization and polishing of workpieces such as semiconductor wafers. It will be understood, however, that the invention is not limited to a particular workpiece type or to a particular manufacturing or polishing environment.

Figure 1:
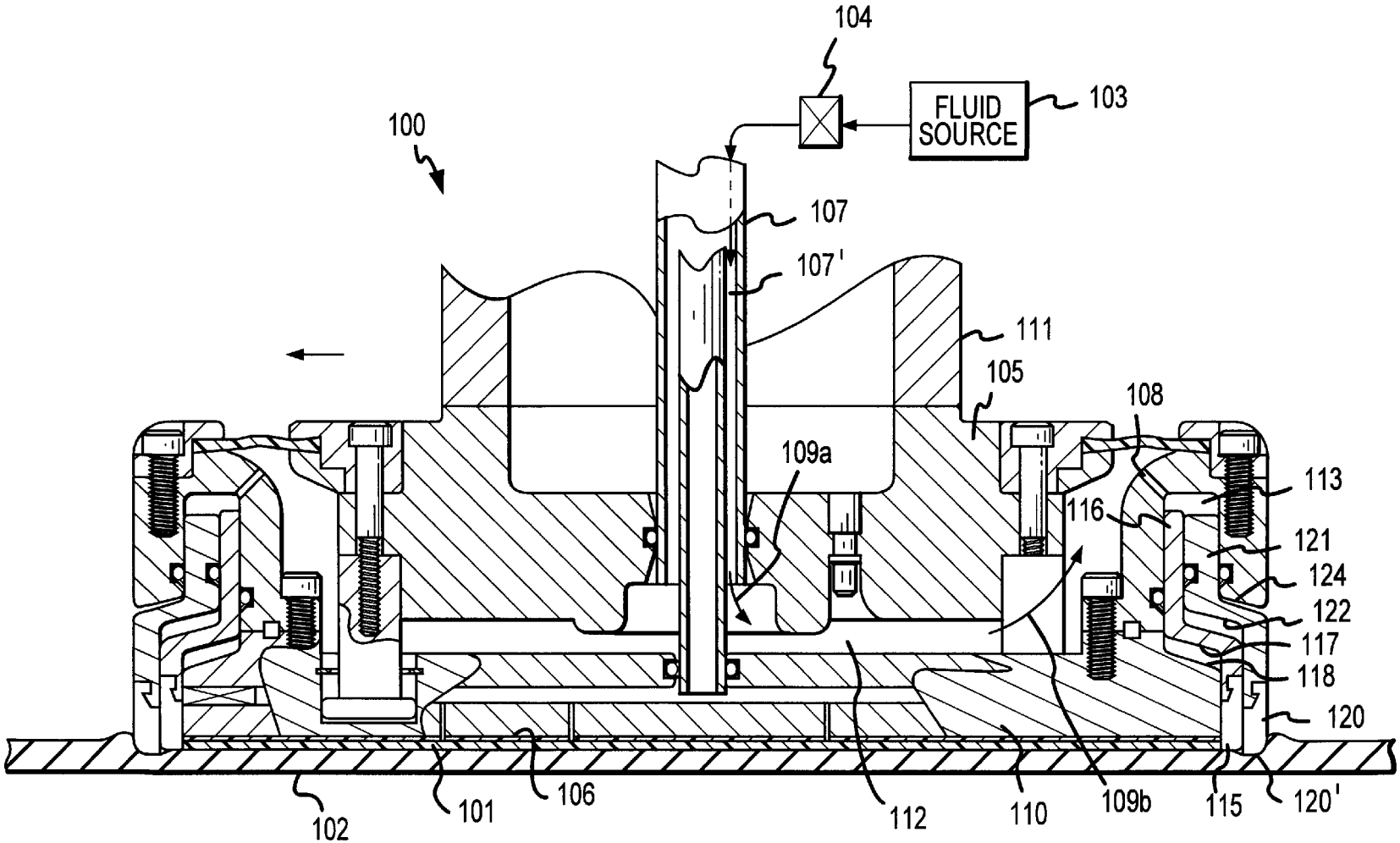
FIG. 1 is a sectional view of a workpiece carrier according to the present invention.

FIG. 1 depicts a wafer carrier 100 according to the present invention. Typically, carrier 100 is mounted at the end of a rotatable and vertically movable drive shaft 111, and above a rotatable polishing pad 102 affixed to a platen (not shown). Wafer carrier 100 and the above components are typically integral to a chemical mechanical polishing machine or a similar workpiece polishing apparatus. Chemical mechanical polishing ('CMP') machines are well known in the art; a detailed description of their construction and operation may be found in U.S. Pat. No. 5,329,732 to Karlsrud et al., the disclosure of which is incorporated herein by reference.

Carrier 100 comprises a housing 105 to which a pressure plate 110 is attached. Pressure plate 110 is a unitary component formed of a rigid material, such as steel. Wafer retaining ring 115 is slidably mounted around pressure plate 110 so that the retaining ring 115 is free to move vertically, with vertical movement limited by stop 118 and the lower surface of flange 122. Retaining ring 115 is concentric with, and extends peripherally beyond, the outside of pressure plate 110 to define a pocket for retaining a wafer 101 to be polished. A compliant wafer backing pad 106 is adhered to the lower surface of pressure plate 110 to cushion wafers held thereby and to protect the wafers against damage which may result from direct contact with the rigid pressure plate. The rear face of the wafer or other workpiece 101 rests in parallel contact against backing pad 106, while the front face of the workpiece is exposed for parallel contact against the top surface of polishing pad 102. The backing pad prevents imperfections or asperities present on the rear face of the wafer from being "telegraphed" through the wafer to its front (polishing) face, which can result in uneven pressure distribution across the wafer front face against the polishing pad which, in turn, can lead to uneven material removal rates and impaired planarization. The backing pad also frictionally engages the rear surface of the wafer, thereby preventing movement or sliding of the wafer relative to the backing pad.

Wafer carrier housing 105 includes primary pressure chamber 112, which is supplied with pressurized air or other fluid via valve 104, which is connected to a pressurized fluid source 103. Carrier housing 105 is pressurized to apply a desired polishing pressure on pressure plate 110. Fluid source 103 typically provides pressurized air, but other fluids/gases could be used to pressurize chamber 112. Pressurized air is introduced into chamber 112 through area 107' within conduit 107. The air pressure in chamber 112 is applied uniformly across substantially all of the surface area of pressure plate 110. Accordingly, the pressure applied by pressure plate 110 to wafer 101 is applied across substantially all of the surface area of wafer 101 to facilitate a more uniform polishing or planarizing of wafer 101. In an exemplary embodiment, primary pressure chamber 112 is pressurized with between 5 and 7 psi of pressure. It should be appreciated, however, that various amounts of pressure can be employed depending on the particular application.

Secondary pressure chamber 113 is also contained within housing 105, and is located peripherally with respect to primary chamber 112. Air pressure applied to chamber 112 causes pressure plate 110 (and attached wafer 101) to be biased against polishing pad 102. The pressurized air in primary chamber 112 is introduced into secondary chamber 113 through fluid inlet aperture 108, where the pressure is employed to bias wafer retaining ring 115 and pad load ring 120 against polishing pad 102. Pad load ring 120 is concentric with, and disposed annularly with respect to, wafer retaining ring 115. Pad load ring 120 provides an area over which wave deformation of polishing pad 102 is allowed to subside so that the amplitude of the deformation is significantly reduced by the time of its arrival at the edge of the wafer 101. In order to allow a smooth transition between the undepressed area of the polishing pad and the area where the polishing pad is depressed by pad load ring 120, the lower outside edge 120' of the pad load ring is preferably radiused to between 1/16 and 1/4 inches.

Secondary pressure chamber 113 contains retaining ring piston 116 and pad load ring piston 121. Piston 116 is connected to wafer retaining ring 115 by connecting flange 117, and piston 121 is connected to pad load ring 120 by connecting flange 122. Air (or other fluid) pressure applied to chamber 113 is translated, via pistons 116/121 and flanges 117/122, respectively, into a biasing force applied to polishing pad 102 by retaining ring 115 and pad load ring 120.

Polishing pad 102 is typically mounted below carrier 100 on a rotatable polishing platen (not shown). The hardness and density of the pad are selected based on the type of material to be planarized. Blown polyurethane pads, such as the IC and GS series of pads available from Rodel Products Corporation of Scottsdale, Ariz., may be advantageously utilized by the apparatus of the present invention. An abrasive slurry, such as an aqueous slurry of silica particles, is typically pumped onto the pad during a polishing operation. The relative movements of carrier 100 and polishing pad 102, augmented by the abrasive action of the slurry, produce a combined chemical and mechanical process at the exposed (lower) face of a wafer 101 affixed to carrier 100 which removes projections and irregularities to produce a substantially flat or planar surface on the lower side of the wafer.

In operation, pressurized air from fluid source 103 is introduced into pressure chamber 112 through area 107' within conduit 107, as indicated by arrow 109*a*. Pressurized air in chamber 112 flows from pressure chamber 112 to aperture 108 (as shown by arrow 109*b*), and through aperture 108 into chamber 113. Thus the present invention utilizes a single fluid source for pressurizing both chambers 112 and 113, thereby obviating the need for the added complexity of additional fluid lines, valves, and associated control equipment required to separately bias the pressure plate and retaining ring. In the present invention, the bias pressure applied by retaining ring 115 and pad load ring 120 to polishing pad 102 is determined by the ratio of the surface area of the top of pistons 116/121 to the surface area of the bottom of rings 115/120, respectively, explained in detail below.

Figure 2:
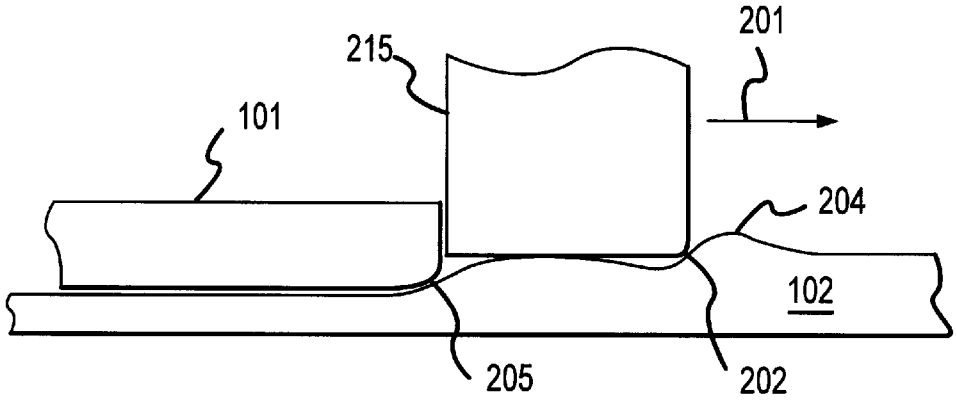
PRIOR ART FIG.2
FIG. 2 is a side view of a polishing pad in contact with a wafer retaining ring of a prior art wafer carrier illustrating wave deformation of the polishing pad.

FIG. 2 is a side view of a polishing pad in contact with a wafer retaining ring of a prior art wafer carrier illustrating wave deformation of the polishing pad. The pad deformation has been exaggerated in FIG. 2 for the purpose of illustration. As the wafer carrier moves in the direction shown by arrow 201 in FIG. 2, the pressure applied through wafer 101 to polishing pad 102 causes the polishing pad to deform underneath the wafer surface, elastic deformation and 'spring-back' (swelling) of the polishing pad along the outer edge of the wafer occurs in the area in front of and underneath retaining ring 215 between reference numbers 204 and 205. In FIG. 2, the retaining ring is secured to the wafer such that the lower surface of the wafer extends beyond the lower surface of the retaining ring. This relative difference in the heights of these two lower surfaces is due to the fact that typical prior art wafer carriers having a fixed retaining ring require that the bottom edge of the wafer, when affixed to the wafer carrier, protrudes below the retaining ring. This protrusion is necessary to allow for the variations in thickness of a typical pre-planarized wafer so that as little as possible of the wafer surface to be planarized is recessed below the bottom of the plane of the retaining ring. In the situation depicted in FIG. 2, pad wave deformation causes beveling of the lower edge 205 of wafer 101.

In prior art wafer carriers having a retaining ring which floats vertically with respect to the wafer, (i.e., where the ring is not rigidly secured to the wafer), even if an attempt is made to maintain the lower surface of the retaining ring flush with the lower surface of the wafer, wave deformation of the polishing pad still causes undesirable beveling of the lower edge of the wafer. Wafer edge-beveling occurs in this situation because the retaining ring 'floats' up and down as it is displaced by the pad wave which travels relative to the wafer surface. The wave generated by the moving wafer/pad is not static relative to the wafer surface because the relative direction of the wafer and pad changes as the wafer is moved across the pad in an arc. As the retaining ring moves upward relative to the wafer, the bottom edge of the wafer contacts the polishing pad, which causes abrasion of the wafer edge.

Figure 3:
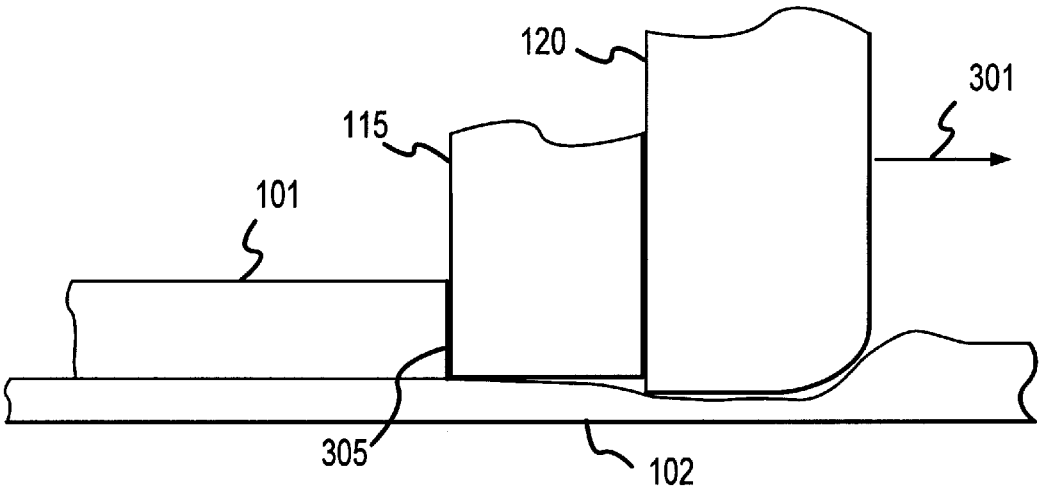
FIG. 3 is a side view of a polishing pad in contact with a wafer retaining ring and a pad load ring illustrating the operation of the present invention in reducing the effect of polishing pad wave deformation.

FIG. 3 is a side view of a polishing pad in contact with a wafer retaining ring and a pad load ring illustrating the operation of the present invention in reducing the effect of polishing pad wave deformation. Again, the pad deformation has been exaggerated for the purpose of illustration. As wafer carrier 100 moves in the direction shown by arrow 301 in FIG. 3, the pressure applied by pad load ring 120 causes the polishing pad to deform underneath the pad load ring surface. Accordingly, uneven deformation of polishing pad 102 is essentially eliminated at edge 305 of wafer 101. The pad load ring 120 thus provides a buffer area which displaces the polishing pad wave deformation away from the edge of the wafer or other workpiece, thereby allowing damping of the deformation before it effects beveling of the lower edge of the workpiece.

Retaining ring 115 is allowed to 'float', relative to the pad load ring 120 and the pressure plate 110. Pad load ring 120 floats in a vertical direction to help damp wave deformation of the polishing pad 102 sufficiently so that the pad deformation is minimized at the wafer/retaining ring interface 305. Retaining ring 120 floats independently of both the pad load ring 115 and also the pressure plate 110 to which the wafer 101 is affixed. Because pad wave deformation has been diminished by the pad load ring 120, retaining ring 120 is not significantly displaced by the effect thereof, thus allowing the lower surface of retaining ring 115 to maintain an optimum vertical position with respect to the lower surface of the wafer. The retaining ring/wafer relative vertical position can be optimized for the characteristics of a given polishing pad by varying the radial width of the lower surface of retaining ring 115 and/or the radial width of the upper surface of piston 116 to provide a desired pressure. In an exemplary embodiment of the present invention, the ratio of widths of retaining ring 115 and piston 116 is approximately one, in order to cause the retaining ring 115 to exert approximately the same amount of bias force on the polishing pad as the pressure plate/wafer 110/101.

Figure 4:
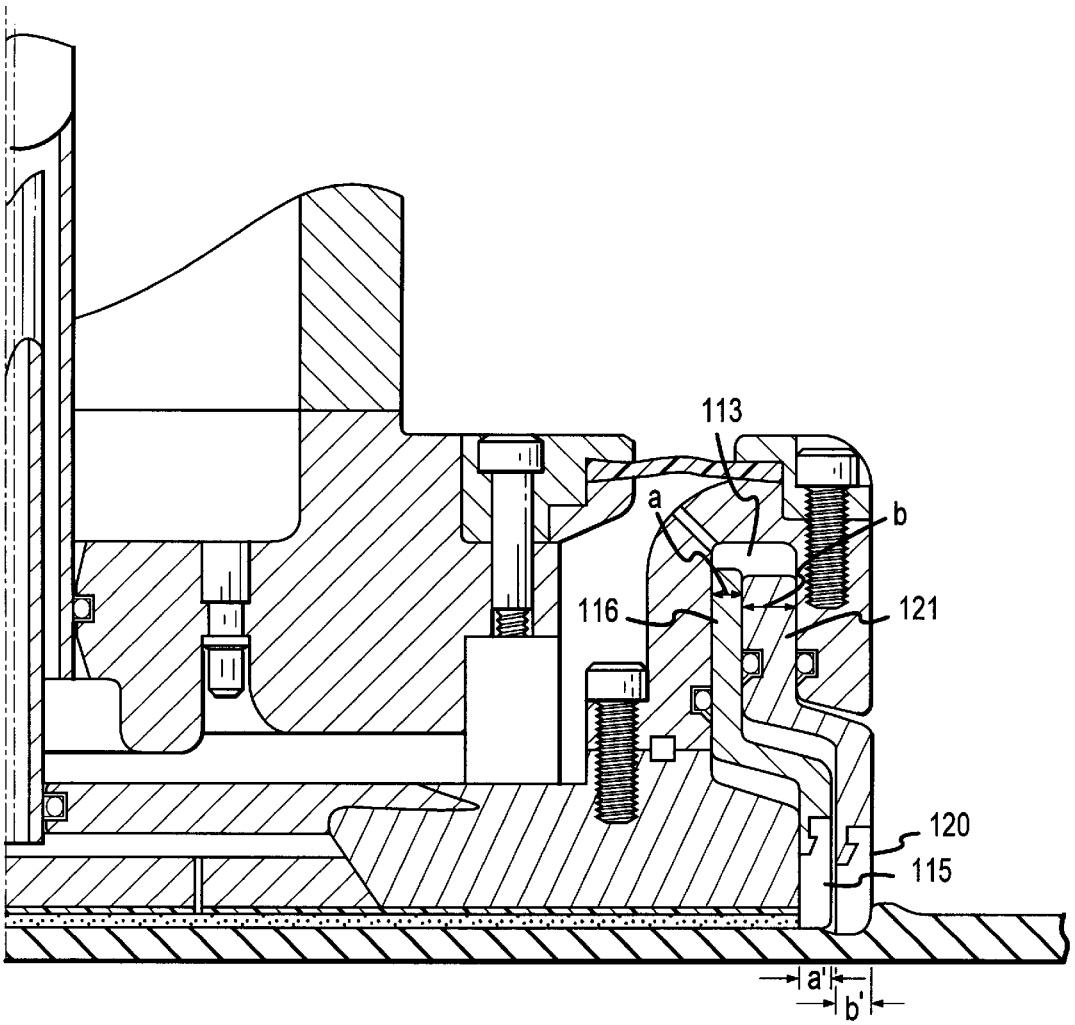
FIG. 4 is an enlarged view of the right half of FIG. 1, showing the lower radial width of a wafer retaining ring and a pad load ring, and the upper radial width of the associated pistons.

FIG. 4 is an enlarged view of the right half of FIG. 1, showing the lower radial widths a' and b' of wafer retaining ring 115 and pad load ring 120, respectively, and the upper radial widths a and b of the associated pistons 116 and 121. The amount of biasing pressure applied to pad 102 is determined by the ratio of the surface area of the top of piston 116 to the surface area of the bottom of wafer retaining ring 115. Likewise, the biasing pressure applied to pad 102 is determined by the ratio of the surface area of the top of piston 121 to the surface area of the bottom of pad load ring 120. Therefore, since rings 115 and 120 move vertically independent of one another, the amount of pressure applied to polishing pad 102 by either ring 115 or 120 can be selectively established by the particular piston/ring surface area ratio chosen in order to compensate for the compliance of a given polishing pad. Furthermore, the vertical movement of both wafer retaining ring 115 and pad load ring 120 is independent of the vertical position of pressure plate 110. Thus, selection of suitable piston/ring surface area ratios allows the biasing force applied to polishing pad 102 to be established for retaining ring 115 and pad load ring 120 separately and independently of the force applied by pressure plate 110. In an exemplary embodiment of the present invention, the biasing pressure applied by pad load ring 120 is preferably between 10 percent and 20 percent greater than the pressure applied to retaining ring 115. As explained above, the biasing pressure applied to retaining ring 115 is preferrably approximately the same as the pressure applied to pressure plate 110.

According to an exemplary embodiment of the present invention, pistons 116/121 and rings 115/120 are cylindrical; therefore the piston/ring surface area ratio of pistons 116/

121 to rings 115/120 is proportional to the radial widths a and b of the top surfaces of pistons 116/121 and the radial widths a' and b' of the lower (polishing pad contact) surfaces of retaining ring 115 and pad load ring 120, respectively. In an exemplary embodiment using a Rodel GS series blown polyurethane polishing pad, preferable radial widths a and b of the top surfaces of pistons 116 and 121, respectively, are established by selecting widths for a and b relative to the widths a' and b' of the lower surfaces of retaining ring 115 and pad load ring 120, such that the ratio a/a' is approximately one, and the ratio b'/b' is 1.15±05.

It is to be understood that the claimed invention is not limited to the description of the preferred embodiment, but encompasses other modifications and alterations within the scope and spirit of the inventive concept.

I claim:

1. A workpiece carrier for holding a workpiece to be planarized against a polishing pad, said workpiece carrier comprising:

a carrier housing;

a retaining ring, for securing said workpiece, connected to said housing and vertically slidable with respect thereto;

a polishing pad load ring annularly disposed about said retaining ring and vertically slidable with respect thereto; and a chamber, disposed within said carrier housing, containing a first piston connected to said retaining ring, and a second piston connected to said pad load ring;

wherein, during a planarizing operation, said chamber is supplied with pressurized fluid to downwardly bias said first piston and said second piston, thereby causing said retaining ring and said pad load ring to separately apply a biasing force against the polishing pad.

2. The workpiece carrier of claim 1, wherein said biasing force applied against the polishing pad by said pad load ring is established by selecting a radial width of the pad load ring lower surface such that the ratio of the surface area of said lower surface-to-the surface area of the upper surface of said second piston provides a biasing force having a magnitude between 10 percent and 20 percent greater than the biasing force applied by said retaining ring.

3. A workpiece carrier for holding a wafer to be planarized against a polishing pad, said workpiece carrier comprising:

a carrier housing;

a rigid pressure plate attached to a lower section of said housing and vertically slidable with respect thereto, wherein said wafer to be planarized is affixed to a lower surface of said plate;

a wafer retaining ring annularly disposed about said pressure plate and vertically slidable with respect thereto;

a polishing pad load ring annularly disposed about said wafer retaining ring and vertically slidable with respect thereto;

a first chamber disposed within said carrier housing for applying fluid pressure to said pressure plate; and a second chamber, disposed within said carrier housing, and connected to said first chamber via an aperture in said carrier housing, said second chamber containing a first piston connected to said wafer retaining ring, and a second piston connected to said pad load ring;

wherein said first chamber is supplied with pressurized fluid to pressurize said second chamber, thereby causing said pad load ring to apply a biasing force against the polishing pad during a planarizing operation; and wherein said pad load ring provides an area over which said pad wave deformation is damped to reduce the effect of said deformation at the edge of the wafer.

4. The workpiece carrier of claim 3, wherein said second piston has an upper surface which is downwardly biased by said pressurized fluid, and wherein said biasing force applied against the polishing pad by said pad load ring is established by selecting the ratio of the radial width of the pad load ring lower surface-to-the radial width of the upper surface of said second piston to provide a biasing force having a magnitude within 110 percent to 120 percent of the force applied to the pressure plate.

5. The method of claim 4, wherein said pad load ring and said retaining ring are free to move vertically independently of one another.

6. A method for reducing the effect, on a semiconductor wafer, of pad wave deformation of a polishing pad during a planarizing operation performed by a wafer carrier including a housing having an attached pressure plate to which the wafer is affixed, a retaining ring, annularly disposed about the pressure plate, for holding the wafer, and a single source of pressurized fluid, comprising the steps of:

disposing a pad load ring annularly with respect to the retaining ring;

forming a pressure chamber within the wafer carrier housing;

disposing a first piston and a second piston within said pressure chamber;

connecting said first piston to the retaining ring and said second piston to said pad load ring; and introducing said pressurized fluid from said single source into said chamber to cause said pad load ring to be biased against the polishing pad;

wherein said pad load ring provides an area over which said pad wave deformation is damped to reduce the effect of said deformation at the edge of the wafer.

7. The method of claim 6, wherein said pad load ring and said retaining ring are free to move vertically independently of one another.

8. The method of claim 7, wherein said pressure plate is biased against said polishing pad by said pressurized fluid, further including the step of:

forming said pad load ring such that the ratio of the radial width of the pad load ring lower surface-to-the radial width of the upper surface of said second piston is established to provide a biasing force having a magnitude within 110 percent to 120 percent of the force applied to the pressure plate.

9. A method for reducing the effect, on an edge of a semiconductor wafer, of pad wave deformation of a polishing pad during a planarizing operation performed by a wafer carrier including a housing having an attached pressure plate to which the wafer is affixed, and a retaining ring for holding the wafer, annularly disposed about the pressure plate, comprising the steps of:

applying a pressurized fluid to a first pressure chamber in said wafer carrier to cause a biasing force to be applied to the pressure plate; and pressurizing a second pressure chamber by supplying said second pressure chamber with pressurized fluid from said first pressure chamber to cause a first biasing force to be applied to the polishing pad via said retaining ring and a second biasing force to be applied to the polishing pad via a pad load ring annularly disposed with respect to said retaining ring;

wherein the lower surfaces of said retaining ring and said pad load ring provide an area over which said pad wave deformation is damped to reduce the effect of said deformation at the edge of the wafer.

10. The method of claim 9, wherein said pad load ring and said retaining ring are free to move vertically independently of one another.

11. The method of claim 10, including the additional steps of:

connecting a first piston disposed in said second pressure chamber to said retaining ring to transfer fluid pressure in said second pressure chamber to said retaining ring to create said first biasing force; and connecting a second piston, disposed in said second pressure chamber, to said pad load ring, for receiving said pressurized fluid to create said second biasing force.

12. The method of claim 11, including the additional step of forming said pad load ring such that the ratio of the radial width of the pad load ring lower surface-to-the radial width of the upper surface of said second piston is established to provide a biasing force having a magnitude within 110 percent to 120 percent of the force applied to the pressure plate.

13. A method for reducing the effect, on an edge of a semiconductor wafer, of pad wave deformation of a polishing pad during a planarizing operation performed by a wafer carrier including a pressure chamber and retaining ring for holding the wafer, comprising the step of:

pressurizing said pressure chamber to cause a first biasing force to be applied to the polishing pad via said retaining ring and a second biasing force to be applied to the polishing pad via a pad load ring annularly disposed and vertically movable with respect to said retaining ring;

wherein the lower surface of said pad load ring provides an area over which said pad wave deformation is damped to reduce the effect of said deformation at the edge of the wafer.

14. The workpiece carrier of claim 13, wherein said biasing force applied against the polishing pad by said pad load ring is established by selecting a radial width of the pad load ring lower surface such that the ratio of the surface area of said lower surface-to-the surface area of the upper surface of said second piston provides a biasing force having a magnitude between 10 percent and 20 percent greater than the biasing force applied by said retaining ring.

* * * * *